US007475519B2

(12) United States Patent
Swann

(10) Patent No.: US 7,475,519 B2
(45) Date of Patent: Jan. 13, 2009

(54) SELF-ADHERED ROOF SYSTEM AND COMPONENTS

(75) Inventor: Raymond C. Swann, Kansas City, MO (US)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 11/605,590

(22) Filed: Nov. 28, 2006

(65) Prior Publication Data

US 2007/0068109 A1 Mar. 29, 2007

Related U.S. Application Data

(62) Division of application No. 10/736,118, filed on Dec. 15, 2003, now abandoned.

(51) Int. Cl.
*E04D 5/02* (2006.01)
*E04D 1/28* (2006.01)

(52) U.S. Cl. ..... 52/746.11; 52/746.1; 52/745.21; 52/411

(58) Field of Classification Search ..... 52/748.1, 52/745.21, 411, 408, 747.11, 746.1, 746.11, 52/518, 554, 555; 428/40.3, 40.2, 41.7, 41.8, 428/40.1, 141, 144; 156/278, 279, 280, 337, 156/324

See application file for complete search history.

(56) References Cited

U.S. PATENT DOCUMENTS 2,210,209 A 8/1940 Kirschbraun
2,472,100 A * 6/1949 Fair, Jr. ..... 428/467
3,294,611 A * 12/1966 Vomela ..... 156/230
3,532,586 A * 10/1970 Davis et al. ..... 428/40.6
3,813,280 A * 5/1974 Olsyzk et al. ..... 428/141
3,929,545 A * 12/1975 Van Dyck et al. ..... 156/220
4,055,453 A * 10/1977 Tajima et al. ..... 156/279
4,396,665 A 8/1983 Rowe
4,670,071 A 6/1987 Cooper et al.
4,755,409 A 7/1988 Harkness
4,780,362 A 10/1988 Ruehl et al.
4,824,880 A * 4/1989 Algrim et al. ..... 524/62
4,965,119 A 10/1990 Sancaktar
4,992,315 A * 2/1991 Zickell et al. ..... 428/40.3
5,143,766 A 9/1992 Wenz et al.
5,232,763 A 8/1993 Holbek et al.
5,496,615 A 3/1996 Bartlett et al.
5,501,056 A * 3/1996 Hannah et al. ..... 52/748.1
5,570,553 A * 11/1996 Balkins ..... 52/518
6,080,458 A * 6/2000 Russell et al. ..... 428/41.7
6,148,578 A * 11/2000 Nowacek et al. ..... 52/518
6,510,664 B2 * 1/2003 Kupczyk ..... 52/528
6,666,938 B1 12/2003 Murphy et al.

(Continued)

*Primary Examiner*—Phi Dieu Tran A
(74) *Attorney, Agent, or Firm*—Robert D. Touslee

(57) ABSTRACT

A self-adhered roof system includes a plurality of waterproof self-adhering base sheets that are self-adhered by watertight bonds to underlying and overlying layers of the roof system and, preferably, waterproof fire-retardant cap sheets that are adhered to an underlying layer formed of the self-adhering base sheets. Base sheet assemblies that each include a base sheet with release sheets overlying its bottom and top major surfaces and, preferably, fire-retardant cap sheet assemblies that each include a fire-retardant cap sheet with release sheets overlying its bottom major surface and a selvage edge portion of its top major surface are utilized to form the self-adhered roof system. The self-adhering base sheets may be used with cap sheets other than fire-retardant cap sheets and with other roof components.

1 Claim, 2 Drawing Sheets

U.S. PATENT DOCUMENTS 6,696,125 B2 2/2004 Zanchetta et al.
6,709,994 B2 * 3/2004 Miller et al. ..... 442/148
6,887,515 B2 * 5/2005 Zickell ..... 427/186
6,895,724 B2 * 5/2005 Naipawer, III ..... 52/748.1
6,925,766 B2 8/2005 Di Pede
6,928,780 B1 8/2005 Hohmann et al.
6,936,329 B2 * 8/2005 Kiik et al. ..... 428/141
6,962,738 B2 11/2005 Swann
7,146,771 B2 * 12/2006 Swann ..... 52/518

* cited by examiner

SELF-ADHERED ROOF SYSTEM AND COMPONENTS

This application is a division of application Ser. No. 10/736,118, filed Dec. 15, 2003.

BACKGROUND OF THE INVENTION

The subject invention relates to roof system components and a roof system that utilizes those components. More specifically, the subject invention relates to waterproof self-adhering base sheet roof system components and a roof system that includes at least one inner layer of the waterproof self-adhering base sheets self-adhered by watertight bonds to underlying and overlying layers of the roof system. Preferably, the roof system components also include waterproof fire-retardant cap sheets and the roof system includes a layer of those cap sheets that are adhered to an underlying layer of the self-adhering base sheets by the self-adhering base sheets.

Current self-adhered modified bitumen roof systems typically include an uppermost layer of cap sheets and one or more underlying roof system layers. The underlying roof system layer or layers may be: one or more base sheet layers and a roof deck; one or more base sheet layers, one or more insulation layers, and a roof deck; one or more insulation layers and a roof deck; or a roof deck.

These current self-adhered roof systems include granule surfaced and smooth surfaced cap sheets that form the topmost layer of the roof systems. One type of current cap sheet includes a reinforcement substrate, such as a fiberglass mat, polyester fiber mat, or a fiberglass/polyester fiber mat, which is encapsulated within top and bottom layers of modified bitumen. The modified bitumen is modified to make the bitumen a self-adhering material. Another type of current cap sheet includes a reinforcement substrate, such as a fiberglass mat, polyester fiber mat, or a fiberglass/polyester fiber mat, which is encapsulated within top and bottom layers of conventionally modified bitumen that is not a self-adhering material. The bottom major surfaces of such cap sheets are coated with self-adhering materials. The self-adhering modified bitumen or the coatings of other self-adhering materials on the bottom major surfaces of these cap sheets are used to self-adhere the cap sheets to underlying roof system layers.

Where the current self-adhered roof systems include one or more inner base sheet layers, the base sheets forming those inner layers include reinforcement substrates, such as a fiberglass mat, polyester fiber mat, or a fiberglass/polyester fiber mat, which are encapsulated within top and bottom layers of modified bitumen that is modified to make the bitumen a self-adhering material. The bottom major surfaces of these base sheets are self-adhering surfaces that are used to bond the base sheets to underlying roof system layers. However, the top major surfaces of these base sheets are surfaced with non-adhering materials, such as but not limited to talc, sand, or polymeric film, which remain on the base sheets after installation so that the top major surfaces of these base sheets are not self-adhering surfaces.

The modification of bitumen to make the bitumen a self-adhering bitumen rather than a conventionally modified bitumen requires: the addition of polymers to the bitumen that are other than the polymers normally used to make a conventional modified bitumen; the addition of conventional polymers to the bitumen in concentrations very different from those normally used to make a conventional modified bitumen; and/or the addition of other vehicles and modifiers to render the bitumen softer and more tacky at application and service temperatures ranging from about 40° F. to about 120° F. Thus, when compared to the conventional Styrene-Butadiene-Styrene (SBS) or Amorphous Polypropylene (APP) modified bitumen of conventional cap and base sheets, the modified self-adhering bitumen used in these cap and base sheets are softer and less resistant to flow (less viscous) when heated or subjected to compressive forces.

When tested in accordance with ASTM Test Designation E 108-00, approved Jan. 10, 2000, published April 2000, and entitled Standard Test Methods for Fire Tests of Roof Coverings (hereinafter "ASTM Test E 108"), roof systems made with conventional cap and base sheets typically meet the requirements of Factory Mutual for a Class A rated roof system. When tested in accordance with Underwriters Labortories, Inc. test designation UL 790 (hereinafter "UL Test 790"), roof systems made with conventional cap and base sheets typically meet the requirements of Underwriters Laboratories, Inc. for a Class A rated roof system. However, when tested in accordance with ASTM Test E 108 by Factory Mutual or in accordance with UL Test 790 by Underwriters Laboratories, Inc., roof systems made with cap and base sheets utilizing the softer, less viscous, self-adhering bitumen are less fire resistant than the roof systems made with conventional cap and base sheets and typically do not achieve a Class A rating.

In addition to being less fire resistant than roof systems made with conventional cap and base sheets, current self-adhered roof systems present another problem. The surfacing of the top major surfaces of the base sheets (inner ply sheets) with talc, sand, polymeric films, or other non-adhesive surfacing materials that remain on the base sheets after installation inhibits the adhesive bonding of self-adhering or conventional cap sheets and other roof system components to the top major surfaces of these base sheets.

SUMMARY OF THE INVENTION

The subject invention provides a unique and effective solution to the current problems associated with roof systems utilizing cap and base sheets made of self-adhering bitumen or other self-adhering materials. The subject invention retains the convenience and labor savings of a self-adhered roof system, enhances the adhesive bonding between self-adhered roof system layers; and provides a self-adhered roof system that when tested in accordance with ASTM Test E 108 meets Factory Mutual requirements for a Class A rated roof system and when tested in accordance with UL Test 790 meets the requirements of Underwriters Laboratories, Inc. for a Class A rated roof system.

The self-adhered roof system of the subject invention includes a plurality of waterproof self-adhering base sheets that are self-adhered by watertight bonds to underlying and overlying layers of the roof system and, preferably, waterproof fire-retardant cap sheets that are adhered to an underlying layer formed of the self-adhering base sheets by the self-adhering base sheets. Base sheet assemblies of the subject invention and, preferably, fire-retardant cap sheet assemblies of the subject invention are utilized to form a self-adhered roof system that passes ASTM Test E 108 and UL Test 790 with a Class A rating.

The base sheet assembly of the subject invention has: a waterproof self-adhering base sheet for forming a watertight roof system layer that will self-adhere to an overlying roof system layer and an underlying roof system layer, a bottom surface release sheet forming a bottom surface of the base sheet assembly, and a top surface release sheet forming a top surface of the base sheet assembly. The waterproof self-adhering base sheet of the assembly has a reinforcing layer encapsulated within self-adhering bitumen that forms the bottom major surface and the top major surface of the waterproof self-adhering base sheet. The bottom surface release sheet overlies and is coextensive with or substantially coextensive with the bottom major surface of the waterproof self-adhering base sheet to protect the bottom major surface of the waterproof self-adhering base sheet from degradation, e.g through the accumuation of dust on the surface, during storage, shipment and handling. The bottom surface release sheet is removable from the bottom major surface of the waterproof self-adhering base sheet immediately prior to installation of the waterproof self-adhering base sheet on an underlying layer of a roof system. With the bottom surface release sheet removed from the bottom major surface of the waterproof self-adhering base sheet, the bottom major surface of the waterproof self-adhering base sheet can be self-adhered by a watertight bond to an underlying roof system layer primarily by the application of pressure. The top surface release sheet overlies and is substantially coextensive with the top major surface of the waterproof self-adhering base sheet to protect the top major surface of the waterproof self-adhering base sheet from degradation during storage, shipment and handling. The top surface release sheet is removable from the top major surface of the waterproof self-adhering base sheet immediately prior to an application of an overlying roof layer to the top major surface of the waterproof self-adhering base sheet. With the top surface release sheet removed from the top major surface of the waterproof self-adhering base sheet, the top major surface the waterproof self-adhering base sheet can be self-adhered by a watertight bond to an overlying roof system layer primarily by the application of pressure.

The cap sheet assembly of the subject invention has: a waterproof fire-retardant cap sheet for forming a watertight topmost layer of a roof system that is adhered to an underlying roof system layer formed by a plurality of the waterproof self-adhering base sheets of the subject invention, a bottom surface release sheet forming a bottom surface of the cap sheet assembly, and a top surface selvage edge portion release sheet forming one lateral edge portion of a top surface of the cap sheet assembly. The waterproof fire-retardant cap sheet has a reinforcing layer encapsulated within a fire-retardant modified bitumen, which forms the bottom major surface and a selvage edge portion of the top major surface of the waterproof fire-retardant cap sheet, and a top major surface surfacing layer forming a remainder of the top major surface of the waterproof fire-retardant cap sheet. The bottom surface release sheet overlies and is coextensive with or substantially coextensive with the bottom major surface of the waterproof fire-retardant cap sheet to protect the bottom major surface of the waterproof fire-retardant cap sheet from degradation during storage, shipment and handling. The bottom surface release sheet is removable from the bottom major surface of the waterproof fire-retardant cap sheet immediately prior to installation of the waterproof fire-retardant cap sheet on an underlying roof system layer formed by a plurality of the waterproof self-adhering base sheets to form a watertight bond with the underlying roof system layer primarily by the application of pressure. The top selvage edge portion release sheet overlies and is coextensive with or substantially coextensive with the selvage edge portion of the top major surface of the waterproof fire-retardant cap sheet to protect the selvage edge portion of the top major surface of the waterproof fire-retardant cap sheet from degradation during storage, shipment and handling. The top selvage edge portion release sheet is removable from the selvage edge portion of the top major surface of the waterproof fire-retardant cap sheet immediately prior to an application and bonding of an overlapping portion of an adjacent cap sheet to the selvage edge portion of the top major surface of the waterproof fire-retardant cap sheet to form a watertight bond with the overlapping portion of the adjacent cap sheet.

The self-adhering base sheets of the subject invention may be used with cap sheets other than the fire-retardant cap sheets of the subject invention and with other roof components.

In this specification and claims, a "self-adhering surface" or a "self-adhering major surface" of a roof component, such as a base sheet or a cap sheet, is a surface that, primarily with the application of pressure, forms a watertight bond with the surface of another roof component without the need to use heat, flame, an additional adhesive material, or hot asphalt material. In this specification and claims, a "self-adhering" roof component, such as a self-adhering base sheet or a self-adhering cap sheet, is a roof component that includes at least one self adhering surface and/or self-adhering major surface.

DESCRIPTION OF THE PREFERRED EMBODIMENTS

Figure 1:
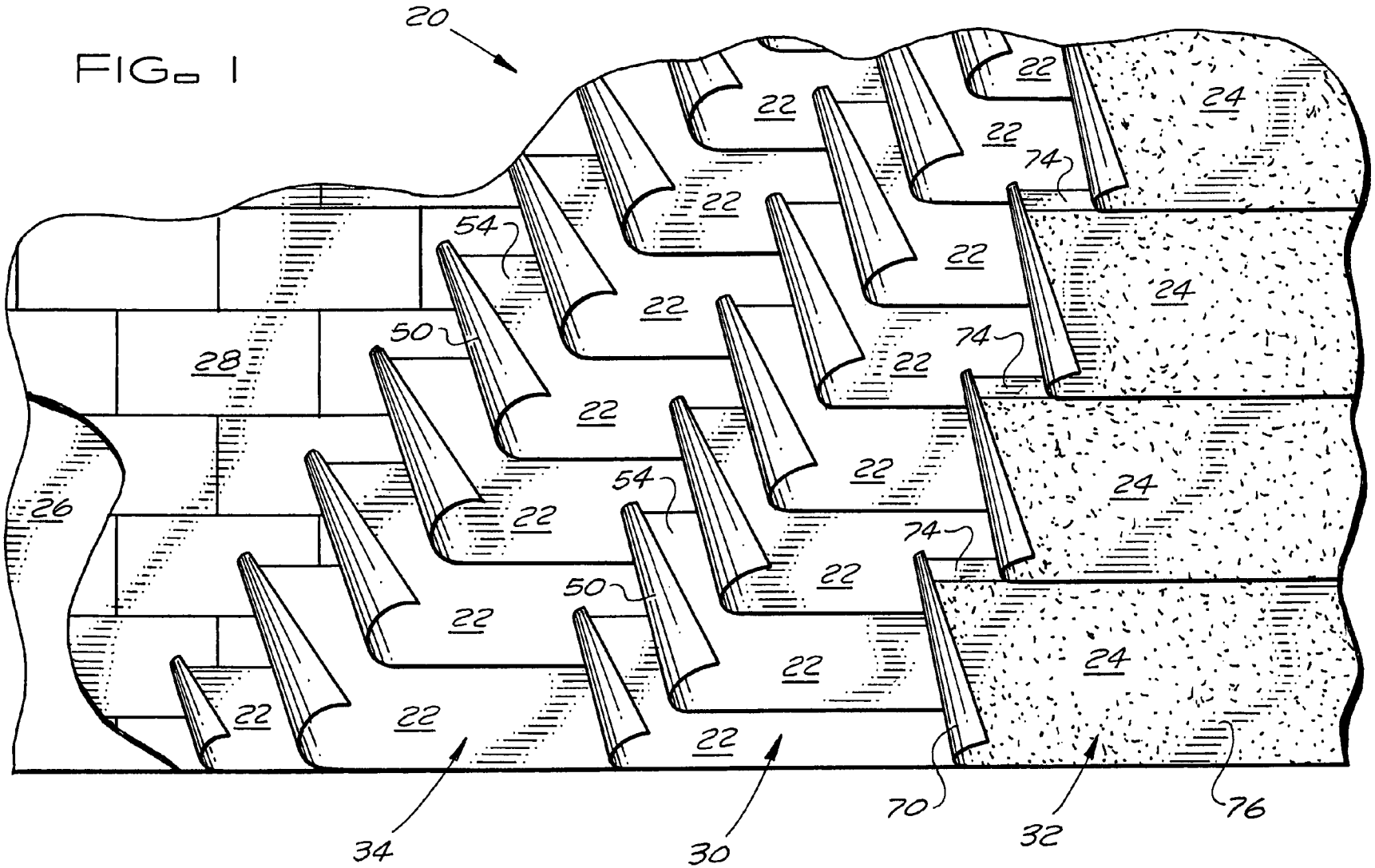
FIG. 1 is a partial schematic view, from above, of a self-adhered roof system of the subject invention with portions broken away to better show the roof system components.

As shown in FIG. 1, the self-adhered roof system 20 of the subject invention includes waterproof self-adhering base sheets 22 and cap sheets 24 that, preferably, are the waterproof fire-retardant cap sheets of the subject invention. The waterproof self-adhering base sheets 22 of the roof system are self-adhered by watertight bonds both to each other to form inner roof system layers and to underlying and overlying layers of the roof system. When used in the roof system 20, the waterproof fire-retardant cap sheets 24 are not self-adhering, but are adhered to each other, e.g. by a cold applied adhesive, and are adhered to an underlying layer formed of the self-adhering base sheets 22 by the self-adhering base sheets.

In a preferred embodiment of the invention, the exposed top or outer layer of the self-adhered roof system 20 is formed by the waterproof fire-retardant cap sheets 24 and the inner roof system layers of the self-adhered roof system 20 are formed by: one or more layers of the waterproof self-adhering base sheets 22 and a roof deck 26; or one or more layers of the waterproof self-adhering base sheets 22, one or more insulation layers 28, and a roof deck 26. In addition to the one or more inner roof system layers formed by the waterproof self-adhering base sheets 22, for certain applications, the lowermost layer of the self-adhered roof system 20, formed by the self-adhering base sheets 22, may be self-adhered to an inner layer formed of conventional base sheets that are in turn bonded by a conventional cold applied adhesive to a roof deck 26 or an insulation layer 28.

Each self-adhering inner layer of the self-adhered roof system 20 is formed by a plurality of overlapping base sheets 22 that are self-adhered to the other base sheets of the self-adhering inner layer to form the self-adhering inner layer. In addition, the self-adhering base sheets 22 of the self-adhering inner layer thus formed are self adhered to overlying and underlying layers of the self-adhered roof system. As shown in FIG. 1, a self-adhering layer 30 of self-adhering base sheets 22 is self-adhered to an overlying outer layer 32 of the fire-retardant cap sheets 24 and an underlying inner layer 34 of self-adhering base sheets 22 or conventional base sheets. Where the underlying layer 34 is also formed of self-adhering base sheets 22, the underlying layer may be self-adhered to the insulation layer 28, as shown in FIG. 1, to another base sheet layer, or directly to the roof deck 26. The roof deck 26 may be a wood, metal or concrete roof deck.

Figure 2:
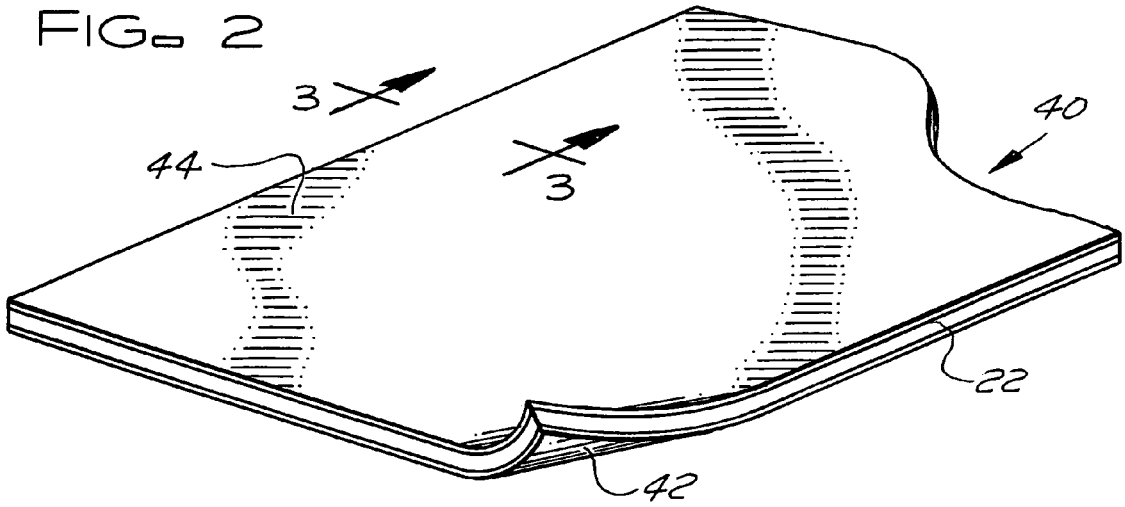
FIG. 2 is a partial schematic perspective view of a base sheet assembly of the subject invention.
Figure 3:
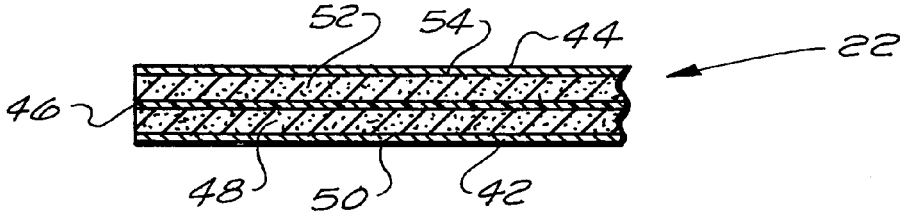
FIG. 3 is a transverse cross section through the base sheet assembly of FIG. 2 taken substantially along lines 3-3 of FIG. 2.

As shown in FIGS. 2 and 3, the base sheet assembly 40 of the subject invention has: a waterproof self-adhering base sheet 22, a bottom surface release sheet 42 that forms a bottom surface of the base sheet assembly, and a top surface release sheet 44 that forms a top surface of the base sheet assembly. With the release sheets 42 and 44 of the base sheet assembly removed, the waterproof base sheet 22 can be self-adhered to other waterproof self-adhering base sheets 22 to form a watertight roof system layer and to an overlying roof system layer and an underlying roof system layer.

The waterproof self-adhering base sheet 22 of the base sheet assembly 40 may be of various lengths, widths, and thicknesses, but preferably is 10 to 20 meters long, 880 to 1020 millimeters wide, and 1 to 4 millimeters thick. The waterproof self-adhering base sheet has a reinforcing layer 46 encapsulated within self-adhering bitumen. The self-adhering bitumen of the waterproof self-adhering base sheet 22 forms a bottom layer 48 and a bottom major surface 50 of the waterproof self-adhering base sheet and a top layer 52 and a top major surface 54 of the waterproof self-adhering base sheet. The bottom major surface 50 and the top major surface 54 of the waterproof self-adhering base sheet 22 are self-adhering surfaces free of surfacing materials such as talc, sand, polymeric films, or other non-adhesive materials.

The reinforcing layer 46 of the waterproof self-adhering base sheet 22 is typically a non-woven polyester, fiberglass, or polyester/fiberglass reinforcement mat. The modified bitumen is bitumen modified to be a self-adhering material. An example of modified bitumen that can be used in the waterproof self-adhering base sheet 22 has the following composition: 40% to 75% by weight asphalt having a penetration when tested @ 25° C. per ASTM D5 of 40 to 200 Dmm and a Ring & Ball Softening Point of 20° to 80° C. when tested per ASTM D36; 0% to 14% by weight Styrene-Butadiene-Styrene (SBS) radical polymer; 0% to 14% by weight Styrene-Butadiene (SB) Diblock polymer; 0% to 20% by weight Colemanite; 0% to 20% by weight Dolomite containing approximately 20% to 30% magnesium carbonate; 0% to 20% by weight Calcium Carbonate; 0.5% to 15% by weight hydrocarbon resin; 0% to 15% by weight Severely Hydrotreated Napthenic Process; and 0% to 0.5% by weight anti-oxidant. The asphalt used in the modified self-adhering bitumen may be, but is not limited to, asphalt marketed by Phillips Conoco Wood River under the trade designation PG58-22. The Styrene-Butadiene-Styrene (SBS) radical polymer used in the modified self-adhering bitumen may be, but is not limited to, Styrene-Butadiene-Styrene (SBS) radical polymer marketed by Polimieri Europa under the trade designation 161B. The Styrene-Butadiene (SB) Diblock polymer used in the modified self-adhering bitumen may be, but is not limited to, Styrene-Butadiene (SB) Diblock polymer marketed by Polimieri Europa under the trade designation 6320. The Dolomite used in the modified self-adhering bitumen may be, but is not limited to, Dolomite marketed by Global Filler Products under the trade designation GFP 250. The Calcium Carbonate used in the modified self-adhering bitumen may be, but is not limited to, Calcium Carbonate marketed by Huber under the trade designation Q 200. The hydrocarbon resin used in the modified self-adhering bitumen may be, but is not limited to, hydrocarbon resin marketed by Sunbelt under the trade designation SB2296. The Severely Hydrotreated Napthenic Process used in the modified self-adhering bitumen may be, but is not limited to, Severely Hydrotreated Napthenic Process marketed by Ergon Refining under the trade designation Hygard L 750.

The bottom surface release sheet 42 of the base sheet assembly 40 may be a conventional release sheet, such as but not limited to, a polymeric or paper sheet having one or both major surfaces treated with silicone or another a suitable release agent. The bottom surface release sheet 42 overlies and is coextensive with or substantially coextensive with the bottom major surface 50 of the waterproof self-adhering base sheet 22 to protect the self-adhering bottom major surface 50 of the waterproof self-adhering base sheet from damage, such as but not limited to the accumulation of dust or other non-adhesive materials on the surface during storage, shipment and handling. The bottom surface release sheet 42 is removable from the bottom major surface 50 of the waterproof self-adhering base sheet 22 immediately prior to installation of the waterproof self-adhering base sheet on an underlying layer of a roof system. With the bottom surface release sheet 42 removed from the bottom major surface 50 of the waterproof self-adhering base sheet 22, the bottom major surface of the waterproof self-adhering base sheet may be self-adhered by a watertight bond to an underlying roof system layer primarily by the application of pressure.

The top surface release sheet 44 of the base sheet assembly 40 may be a conventional release sheet, such as but not limited to, a polymeric or paper sheet having one or both major surfaces treated with silicone or another a suitable release agent. The top surface release sheet 44 overlies and is substantially coextensive with the top major surface 54 of the waterproof self-adhering base sheet 22 to protect the self-adhering top major surface of the waterproof self-adhering base sheet from damage, such as but not limited to the accumulation of dust or other non-adhesive materials on the surface during storage, shipment and handling. The top surface release sheet 44 is removable from the top major surface 54 of the waterproof self-adhering base sheet 22 immediately prior to an application of an overlying roof layer to the top major surface of the waterproof self-adhering base sheet. With the top surface release sheet 44 removed from the top major surface 54 of the waterproof self-adhering base sheet 22, the top major surface 54 the waterproof self-adhering base sheet may be self-adhered by a watertight bond to an overlying roof system layer primarily by the application of pressure.

Figure 4:
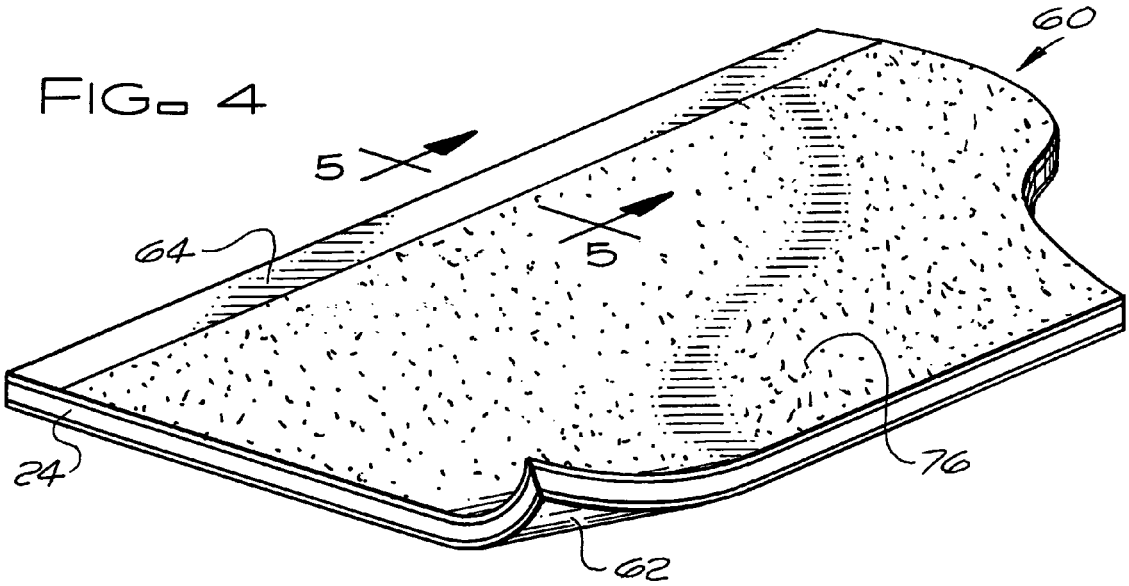
FIG. 4 is a partial schematic perspective view of a cap sheet assembly of the subject invention.
Figure 5:
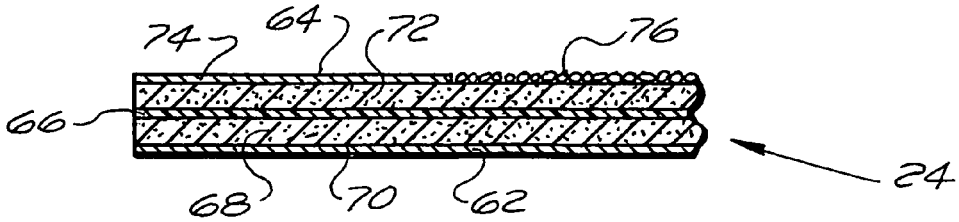
FIG. 5 is a transverse cross section through the cap sheet assembly of FIG. 4 taken substantially along lines 5-5 of FIG. 4.

As shown in FIGS. 4 and 5, the cap sheet assembly 60 of the subject invention has: a waterproof fire-retardant cap sheet 24, a bottom surface release sheet 62 that forms a bottom surface of the cap sheet assembly, and a top surface selvage edge portion release sheet 64 that forms one lateral edge portion of a top surface of the cap sheet assembly. With the bottom release sheet 62 of the cap sheet assembly removed, the waterproof fire-retardant cap sheet 24 can be adhered to an underlying roof system layer formed by a plurality of the waterproof self-adhering base sheets 22 by pressing the cap sheet 24 against the self-adhering surface of the underlying roof system layer formed by the waterproof self-adhering base sheets 22. With the top surface selvage edge portion release sheet 64 removed, the selvage edge portion of the cap sheet 24 may be bonded to an overlapping lateral edge portion of another cap sheet to form a watertight topmost layer of a roof system, e.g. primarily by the application of pressure and heat, a cold applied adhesive, sealing tape, etc.

The waterproof fire-retardant cap sheet 24 of the cap sheet assembly 60 may be of various lengths, widths, and thicknesses, but preferably, is 10 to 15 meters long, 880 to 1020 millimeters wide, and 2 to 5 millimeters thick. The waterproof fire-retardant cap sheet 24 has a reinforcing layer 66 encapsulated within fire-retardant modified bitumen. The fire-retardant modified bitumen forms a bottom layer 68 and a bottom major surface 70 of the waterproof fire-retardant cap sheet 24. The fire-retardant modified bitumen also forms a top layer 72 and a selvage edge portion surface 74 of the top major surface of the waterproof fire-retardant cap sheet. The selvage edge portion surface 74 of the top major surface of the waterproof fire-retardant cap sheet 24 is typically about 75 to 520 millimeters wide and extends along one lateral edge of the cap sheet for the entire length of the cap sheet. The remainder 76 of the top major surface of the waterproof fire-retardant cap sheet 24 is surfaced with a conventional surfacing material such as but not limited to roofing granules, sand, or other coating materials. The bottom major surface 70 and the selvage edge portion 74 of the top major surface of the waterproof fire-retardant cap sheet 24, while not self-adhering surfaces, are free of surfacing materials such as talc, sand, polymeric films or other non-adhesive materials to facilitate the bonding of the bottom major surface 70 of the cap sheet to an underlying roof system layer of self-adhering base sheets 22 and the selvage edge portion surface 74 of the cap sheet to an overlapping lateral edge portion of another cap sheet.

The reinforcing layer 66 of the waterproof fire-retardant cap sheet 24 is typically a non-woven polyester, fiberglass, or polyester/fiberglass reinforcement mat. The modified bitumen is bitumen, modified with fire-retardant materials, polymers, fillers and additives, to be a fire-retardant material. An example of modified bitumen that can be used in the waterproof fire-retardant cap sheet 24 has the following composition: 40% to 75% by weight asphalt having a penetration when tested@ 25° C. per ASTM D5 of 40 to 200 Dmm and a Ring & Ball Softening Point of 200 to 80° C. when tested per ASTM D36; 4% to 12% by weight Styrene-Butadiene-Styrene (SBS) radical polymer; 10% to 35% by weight Colemanite; 10% to 30% by weight Dolomite containing approximately 20% to 30% magnesium carbonate; 0% to 10% by weight Calcium Carbonate; and 0% to 0.5% by weight antioxidant. The asphalt used in the modified fire-retardant bitumen may be, but is not limited to, asphalt marketed by Phillips Conoco Wood River under the trade designation PG58-22. The Styrene-Butadiene-Styrene (SBS) radical polymer used in the modified fire-retardant bitumen may be, but is not limited to, Styrene-Butadiene-Styrene (SBS) radical polymer marketed by Polimieri Europa under the trade designation 161B. The Dolomite used in the modified self-adhering bitumen may be, but is not limited to, Dolomite marketed by Global Filler Products under the trade designation GFP 250. The Calcium Carbonate used in the modified self-adhering bitumen may be, but is not limited to, Calcium Carbonate marketed by Huber under the trade designation Q 200.

The bottom surface release sheet 62 of the cap sheet assembly 60 may be a conventional release sheet, such as but not limited to, a polymeric or paper sheet having one or both major surfaces treated with silicone or another a suitable release agent. The bottom surface release sheet 62 overlies and is coextensive with or substantially coextensive with the bottom major surface 70 of the waterproof fire-retardant cap sheet 24 to protect the bottom major surface of the waterproof fire-retardant cap sheet from damage, such as but not limited to, the accumulation of dust or other non-adhesive materials on the surface during storage, shipment and handling that would inhibit the bonding of the surface to an inner layer of self-adhering base sheets 22. The bottom surface release sheet 62 is removable from the bottom major surface 70 of the waterproof fire-retardant cap sheet immediately prior to installation of the waterproof fire-retardant cap sheet on an underlying self-adhering roof system layer formed by a plurality of the waterproof self-adhering base sheets 22 to form a watertight bond with the underlying roof system layer primarily by the application of pressure.

The top selvage edge portion release sheet 64 may be a conventional release sheet, such as but not limited to, a polymeric or paper sheet having one or both major surfaces treated with silicone or another a suitable release agent. The top surface selvage edge portion release sheet 64 overlies and is coextensive with or substantially coextensive with the selvage edge portion surface 74 of the top major surface of the waterproof fire-retardant cap sheet 24 to protect the selvage edge portion of the top major surface of the waterproof fire-retardant cap sheet from damage, such as but not limited to, the accumulation of dust or other non-adhesive materials on the surface during storage, shipment and handling. The top selvage edge portion release sheet 64 is removable from the selvage edge portion 74 of the top major surface of the waterproof fire-retardant cap sheet 24 immediately prior to an application and bonding of an overlapping lateral edge portion of an adjacent cap sheet to the selvage edge portion 74 of the top major surface of the waterproof fire-retardant cap sheet to form a watertight bond with the overlapping portion of the adjacent cap sheet.

The self-adhering base sheets 22 of the subject invention may be used with cap sheets other than fire-retardant cap sheets 24 of the subject invention and with other roof components.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A method of making a self-adhered roof system from base sheet assemblies and cap sheet assemblies, comprising:

providing a plurality of the base sheet assemblies; each of the base sheet assemblies consisting essentially of a waterproof self-adhering base sheet for forming a watertight roof system layer that is self-adhered to art underlying roof system layer and an overlying roof system layer, a bottom surface release sheet forming a bottom surface of me base sheet assembly, and a top surface release sheet forming a top surface of the base sheet assembly; the waterproof self-adhering base sheet having a length, a width and a thickness; the waterproof self-adhering base sheet having a bottom major surface and a top major surface defined by the length and the width of the waterproof self-adhering base sheet; the waterproof self-adhering base sheet consisting of a reinforcing layer encapsulated within a self-adhering bitumen that forms the bottom major surface and the top major surface of the waterproof self-adhering base sheet the bottom surface release sheet overlying and being substantially coextensive with the bottom major surface of the waterproof self-adhering base sheet and being removable from the bottom major surface of the waterproof self-adhering base sheet immediately prior to installation of the waterproof self-adhering base sheet on an underlying roof system layer with the bottom surface release sheet removed from the bottom major surface of the waterproof self-adhering base sheet the bottom major surface of the waterproof self-adhering base sheet being self-adhering for forming a watertight bond with an underlying roof system layer by die application of pressure; the top surface release sheet overlying and being substantially coextensive with the top major surface of the waterproof self-adhering base sheet and being removable from the top major surface of the waterproof self-adhering base sheet immediately prior to an application of an overlying roof system layer to the top major surface of the waterproof self-adhering base sheet; with the top surface release sheet removed from the top major surface of the waterproof self-adhering base sheet, the top major surface the waterproof self-adhering base sheet being self-adhering for forming a watertight bond with an overlying roof system layer by the application of pressure;

forming a watertight root system layer with a plurality of the waterproof self-adhering base sheets by removing the bottom surface release sheets from the plurality waterproof self-adhering base sheets and pressing the bottom major surfaces of the waterproof self-adhering base sheets against an underlying roof system layer;

providing a plurality of the cap sheet assemblies; each of the cap sheet assemblies consisting essentially of one waterproof fire-retardant cap sheet for forming a watertight topmost roof system layer when adhered to an underlying roof system layer formed by the waterproof self-adhering base sheets, a bottom surface release sheet forming a bottom surface of the cap sheet assembly, and a top surface selvage edge portion release sheet forming one lateral edge portion of a top surface of the cap sheet assembly; the waterproof fire-retardant cap sheet having a length, a width and a thickness; the waterproof fire-retardant cap sheet having a bottom major surface and a top major surface defined by the length and the width of the waterproof fire-retardant cap sheet the waterproof fire-retardant cap sheet consisting of a reinforcing layer encapsulated within a non self-adhering fire-retardant modified bitumen, which forms the bottom major surface arid a selvage edge portion of the top major surface of the waterproof fire-retardant cap sheet, and a top major surface coating layer forming a remainder of the top major surface of the waterproof fire-retardant cap sheet the bottom major surface and the selvage edge portion of the top major surface being non self-adhering; the bottom surface release sheet overlying and being substantially coextensive with the bottom major surface of the waterproof fire-retardant cap sheet and being removable from the bottom major surface of the waterproof fire-retardant cap sheet immediately prior to installation of the waterproof fire-retardant cap sheet on an underlying roof system layer formed by the waterproof self-adhering base sheets to form a watertight bond with the underlying roof system layer of waterproof self-adhering base sheets by the application of pressure; the top salvage edge portion release sheet overlying and being substantially coextensive with the selvage edge portion of the top major surface of the waterproof fire-retardant cap sheet and being removal from the selvage edge portion of the top major surface of the waterproof fire-retardant cap sheet immediately prior to an application and bonding of an overlapping portion of an adjacent cap sheet to the salvage edge portion cit the top major surface of the waterproof fire-retardant cap sheet to form a watertight bond with the overlapping portion of the adjacent cap sheet by the application of pressure; and forming an overlying roof system layer of the waterproof fire-retardant cap sheets and a watertight bond between the overlying roof system layer of the waterproof fire-retardant cap sheet and the watertight roof system layer formed of the plurality of waterproof self-adhering base sheets by removing the top surface release sheets from the plurality of waterproof self-adhering base sheets, the bottom release sheets from the waterproof fire-retardant cap sheets, and pressing non self-adhering bottom major surfaces of the waterproof fire-retardant cap sheets of the overlying roof system layer against the self-adhering top major surfaces of the plurality of waterproof self-adhering base sheets.

* * * * *